US005976421A

United States Patent [19]

Groen

[11] Patent Number: 5,976,421

[45] Date of Patent: Nov. 2, 1999

[54] INDIUM-CONTAINING, OXIDE-CERAMIC THERMISTOR

[75] Inventor: Wilhelm A. Groen, Limbricht, Netherlands

[73] Assignee: U.S. Philips Corporation, New York, N.Y.

[21] Appl. No.: 08/863,349

[22] Filed: May 29, 1997

[30] Foreign Application Priority Data

Jun. 1, 1996 [DE] Germany ..... 196 22 112

[51] Int. Cl.[6] ..... H01C 7/04; H01B 1/08

[52] U.S. Cl. ..... 252/521.2; 252/519.1; 338/22 SD; 338/22 R

[58] Field of Search ..... 252/519.1, 521.2; 338/22 SD, 22 R

[56] References Cited

U.S. PATENT DOCUMENTS

| | | | |
|---|---|---|---|
| 4,347,166 | 8/1982 | Tosaki et al. | 252/519 |
| 5,246,628 | 9/1993 | Jung et al. | 252/519 |
| 5,830,268 | 11/1998 | Rosen et al. | 117/2 |

FOREIGN PATENT DOCUMENTS

| | | | |
|---|---|---|---|
| 4213629C1 | 2/1994 | Germany | C04B 35/00 |

*Primary Examiner*—Mark Kopec
*Attorney, Agent, or Firm*—Daniel E. Tierney

[57] ABSTRACT

A thermistor comprising a semiconductor ceramic with an oxide spinel, which contains the elements maganese, nickel and indium. Thermistors of said composition are thermally stable and are characterized by a high resistivity and a high B-value.

4 Claims, 1 Drawing Sheet

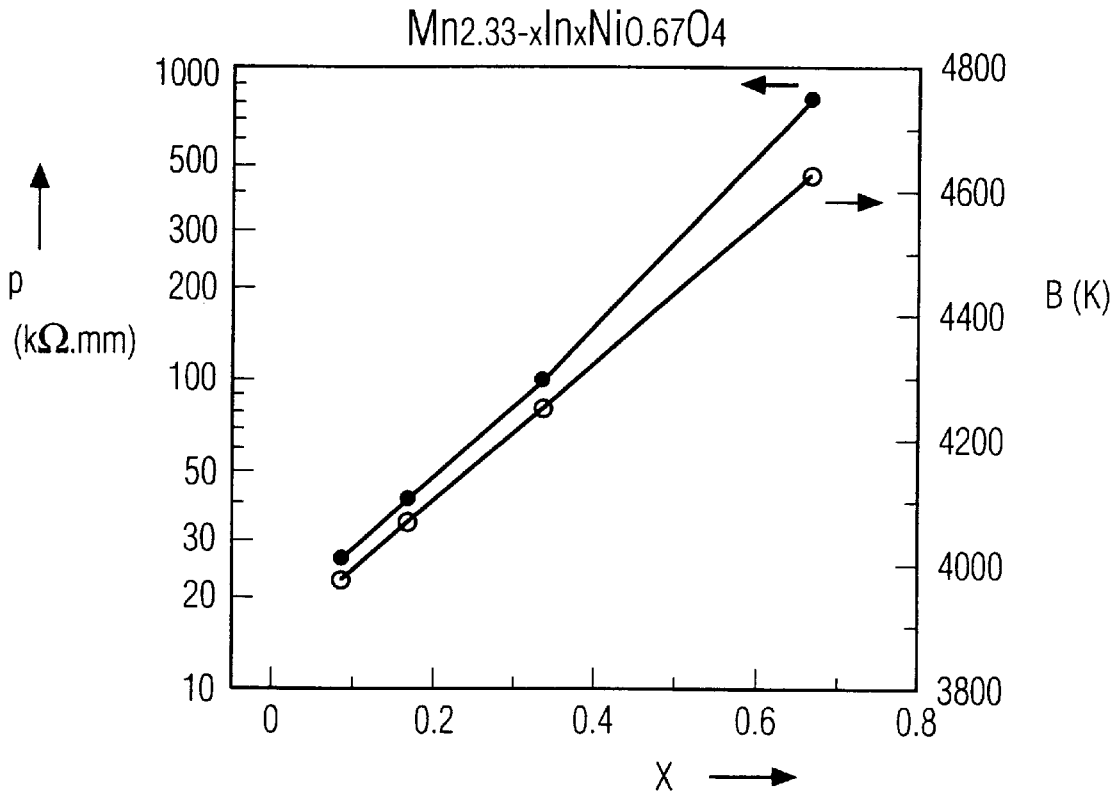
Mn2.33-xInxNi0.67O4
1000
500
300
200
100
50
30
20
10
p
(kΩ.mm)
4800
4600
4400
4200
4000
3800
B (K)
0
0.2
0.4
0.6
0.8
X

INDIUM-CONTAINING, OXIDE-CERAMIC THERMISTOR

The invention relates to a thermistor comprising a semiconductor ceramic having an oxide spinel.

Thermistors, also referred to as NTC resistors, have a negative temperature coefficient (NTC), i.e. their resistivity decreases approximately exponentially with temperature. For the materials which determine the resistance use is customarily made of semiconductive oxide ceramics. Ceramic thermistors are widely used as temperature sensors, for example, in the foodstuff industry and synthetic-resin industry, in electronic motorcar equipment, in mobile industrial-type measuring devices and in medical technology, for example as fever thermometers. A part of the applications relates to the temperature compensation of coils, the stabilization of the operating point of transistors and the protection of electronic devices against overheating. Ceramic thermistors can also advantageously be used in the low-temperature measuring technique, as radiation receivers in pyrometers and as pick-up devices in flow anemometers.

Semiconductive oxide ceramics having a negative temperature coefficient (NTC) are manifold. In order to be practicable, resistors should not only be temperature-dependent but also exhibit other characteristics such as a good sinterability, and mechanical and chemical stability.

An important group of ceramic materials for the manufacture of thermistors are oxide spinels. Oxide spinels are ion crystals having the composition $AB_2O_4$, whose structure is determined by the cubic close packing of the large, negatively charged oxygen ions $O^{2-}$. The relatively large A cations occupy octahedron vacancies in the anion lattice, the relatively small B cations occupy the tetrahedron vacancies in the anion lattice. The current thermistor components are based almost exclusively on mixed crystals with a spinel structure, which are generally composed of 2 to 4 cations of the group formed by manganese, nickel, cobalt, iron, copper and titanium. However, the thermal stability of these compounds is problematic. To obtain uniform spinel phases, already in the manufacturing process an accurate process control is required. In addition, the operating temperatures must not exceed specific limiting values.

In DE 42 13 629 it is proposed to manufacture NTC resistors having the general formula $Zn_zFe_{z-x}^{III}Ni\ Mn_{2-x-z}^{III}Mn_Z^{IV}O_4$, wherein $0>z<x$. These oxide spinels form a uniform spinel phase; they do not decompose into separate oxide phases during the manufacture and hence for their manufacture use can be made of a reproducible setting of the thermistor parameters.

In practice, however, interaction with the atmosphere causes the oxidation number of iron to change in these spinel phases, so that also the thermistor parameters are subject to change. Moreover, in this manner only spinels having specific thermistor-parameter ranges can be manufactured.

Therefore, it is an object of the invention to provide a thermistor comprising a semiconductor ceramic with an oxide spinel, which is thermally stable and exhibits high values for the thermistor parameters.

In accordance with the invention, this object is achieved by a thermistor comprising a semiconductor ceramic with an oxide spinel, which contains the elements manganese, nickel and indium.

A thermistor comprising a semiconductor ceramic with an oxide spinel, which contains the element manganese, nickel and indium, has a very high thermodynamic stability because indium has only one oxidation number (+3) and hence does not react with atmospheric oxygen. In addition, such a thermistor is characterized by a high resistivity and a high value of B.

Within the scope of the invention, the spinel preferably has the composition $Mn_{2.33-x}In_xNi_{0.67}O_4$, wherein $0.05 \leqq x \leqq 0.75$. These spinels are characterized by a very high stability at high operating temperatures, which can be attributed to the fact that their crystal structure is monomorphous, i.e. it does not change at high temperatures.

Preferably, the spinel has the composition $Mn_{2.33-x}In_xNi_{0.67}O_4$, wherein $0.5 \leqq x \leqq 0.66$.

It is particularly preferred that the spinel has the composition $Mn_{2.33-x}In_xNi_{0.67}O_4$, wherein $x=0.58\pm0.02$. If a thermistor having such a composition is subjected to a life test, it exhibits a surprisingly high thermal stability of the resistance value.

These and other aspects of the invention will be apparent from and elucidated with reference to the embodiments described hereinafter.

In the drawings:

FIG. 1 shows the resistivity and B-value as a function of the indium content x in $Mn_{2.33-x}In_xNi_{0.67}O_4$.

The thermistor in accordance with the invention comprises a semiconductor ceramic with an oxide spinel, which contains the elements manganese, nickel and indium, whose composition corresponds to $Mn_{2.33-x}In_xNi_{0.67}O_4$, wherein $0.05 \leqq x \leqq 0.75$. By virtue of the low electron affinity and the high ionization potential of indium (+III), this oxide spinel is redox-stable and does not change as a result of interaction with the atmosphere at elevated temperatures.

The composition of the spinel is preferably so selected that it is near the phase transition from the cubic spinel structure to the tetragonal spinel structure, and that it has the composition $Mn_{2.33-x}In_xNi_{0.67}O_4$, wherein $0.05 \leqq x \leqq 0.75$. It has surprisingly been found that these compositions exhibit a minimum degree of ageing.

The thermistor is manufactured in accordance with the methods which are customarily used to manufacture ceramic materials, and dependent upon the desired tolerances and the field of application, many different versions of thermistors are possible. For the starting compounds use can be made of oxides, hydroxides, carbonates, oxalates, and such. These starting compounds are weighed-in according to the desired composition, subjected to a wet-grinding process, dried and granulated. Subsequently, the oxide mixture may be calcined at a temperature ranging from 900° C. to 1,000° C. so as to produce a pre-densified and chemically homogenized mixture. The calcined mixture is ground again and suspended in a binder composition. Subsequently, the suspended mixture is subjected to a shaping operation. The powder suspension can be cast into foils or screen printed onto a substrate to form circuits in thick-film technique. The suspension may alternatively be formed into granular material which can subsequently be compression moulded to form articles of any desirable shape. Subsequently, the binder is burned out first and then the final sintering operation takes place, in which the spinel phase is formed. The contacts are provided in a further process step.

Single-phase oxide spinels are formed which contain the elements manganese, nickel and indium. This is confirmed by x-ray examinations.

EXAMPLE

Semiconductor ceramics comprising oxide spinels are produced, which have the composition $Mn_{2.33-x}In_xNi_{0.67}O_4$, wherein x=1/12, 1/6, 1/3 and 2/3. The corresponding starting oxides are mixed in stoichiometric ratios and ground for 16 hours by means of zirconium grinding balls. The pre-mixed powder is granulated with a conventional binder preparation. In a compression process, pellets having a diameter of 6 mm and a thickness of 1 mm are formed from said granular material. The pellets are sintered in air for 6 hours at 1250° C. X-ray diffraction recordings show that the semiconductor ceramic thus obtained is a single-phase material having a spinel structure. The relative density of the mixed-crystal oxides is more than 97% of the theoretical density.

Test results

FIG. 1 shows that the most important thermistor parameters, i.e. the resistivity ($R_{25}$) and the B-value increase as the indium content increases.

The ageing tests are carried out at 150° C. for 1800 hours. In these tests, the thermistor parameters $R_{25}$ and the thermal constant B were measured periodically. The test results show that the ageing process is substantially completed after 150 hours. They further show that the relative change of the resistance $R/R_0$ with time has a minimum near the phase transition between the cubic and the tetragonal phase boundary.

I claim:

1. A thermistor comprising a semiconductor ceramic having an oxide spinel, which contains the elements manganese, nickel and indium.

2. A thermistor as claimed in claim 1, characterized in that the composition of the spinel corresponds to $Mn_{2.33-x}In_xNi_{0.67}O_4$, wherein $0.05 \leqq x \leqq 0.75$.

3. A thermistor as claimed in claim 1, characterized in that the composition of the spinel corresponds to $Mn_{2.33-x}In_xNi_{0.67}O_4$, wherein $0.05 \leqq x \leqq 0.66$.

4. A thermistor as claimed in claim 1, characterized in that the composition of the spinel corresponds to $Mn_{2.33-x}In_xNi_{0.67}O_4$, wherein $x=0.58 \pm 0.02$.

* * * * *